US005651709A

United States Patent [19]

Nandakumar et al.

[11] Patent Number: 5,651,709

[45] Date of Patent: Jul. 29, 1997

[54] CANTENARY ANCHOR LEG MOORING BUOY

[75] Inventors: Bhaskaran Nair Nandakumar; Alan Hooper; Hans J. Hvide, all of Singapore, Singapore

[73] Assignee: Nortrans Engineering Group Pte Ltd., Singapore

[21] Appl. No.: 555,413

[22] Filed: Nov. 9, 1995

[51] Int. Cl.[6] ..... B63B 22/02

[52] U.S. Cl. ..... 441/5; 114/293

[58] Field of Search ..... 114/230, 293; 441/3, 4, 5, 23

[56] References Cited

U.S. PATENT DOCUMENTS

| | | | |
|---|---|---|---|
| Re. 32,478 | 8/1987 | Poldervaart et al. | 441/5 |
| D. 248,840 | 8/1978 | Aesch, Sr. et al. . | |
| D. 310,180 | 8/1990 | Etkin . | |
| 2,354,441 | 7/1944 | Diehl . | |
| 2,814,055 | 11/1957 | Phillips . | |
| 2,911,658 | 11/1959 | Stanley, Jr. . | |
| 3,049,732 | 8/1962 | Martin . | |
| 3,324,661 | 6/1967 | Hoglund . | |
| 3,431,568 | 3/1969 | Brown | 114/230 |
| 3,674,225 | 7/1972 | Johnson . | |
| 3,742,536 | 7/1973 | Sada et al. | 114/230 |
| 3,943,871 | 3/1976 | Tanaka . | |
| 4,042,990 | 8/1977 | Donaldson, Jr. | 441/5 |
| 4,604,961 | 8/1986 | Ortloff et al. | 441/5 |
| 5,339,760 | 8/1994 | Korsgaard | 441/3 |
| 5,350,330 | 9/1994 | Platis | 441/6 |

FOREIGN PATENT DOCUMENTS

| | | |
|---|---|---|
| 0134596 | 3/1985 | European Pat. Off. . |
| 2112338A | 8/1983 | United Kingdom . |

*Primary Examiner*—Jesus D. Sotelo

*Attorney, Agent, or Firm*—Jones, Tullar & Cooper, P.C.

[57] ABSTRACT

An offshore terminal mooring buoy of the cantenary anchor leg mooring (CALM) type includes a buoy which is designed to dive at an angle downwardly through large swells during bad weather. The buoy has a wedge shaped side cross-section including an inwardly angled upper side-wall that not only causes the buoy to dive through large swells, but also reduces its drag coefficient so that undue stresses will not be placed on the buoy's anchor chains as it dives through the water. The bottom submerged portion of the buoy can also incorporate a wedged shape to decrease its drag coefficient further. Preferably, the buoy also has a hexagonal shaped top cross-section which further reduces the buoy's drag coefficient, and makes the buoy easy to fabricate.

17 Claims, 2 Drawing Sheets

FIG. 2
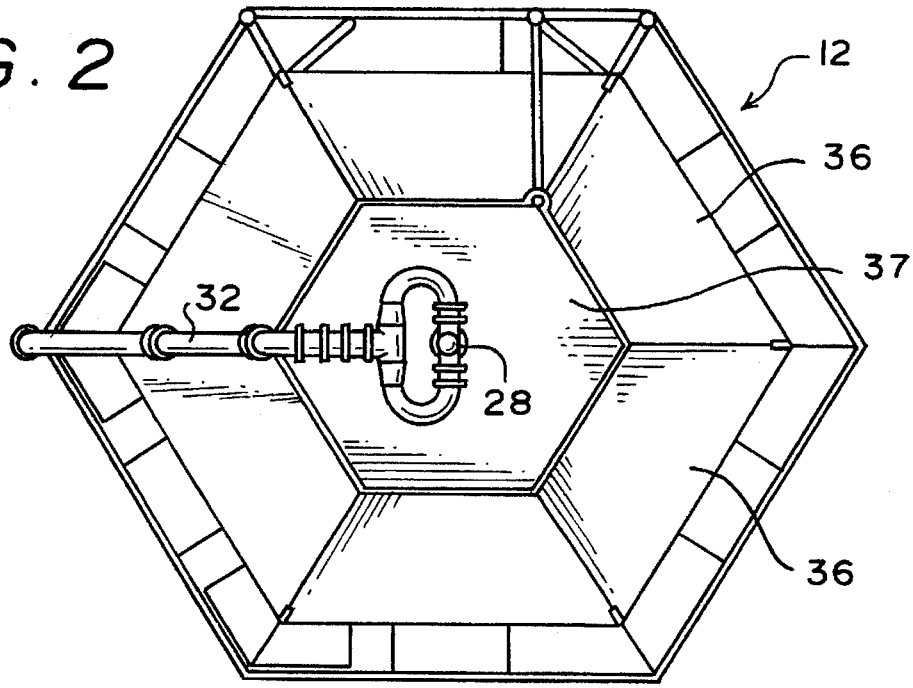
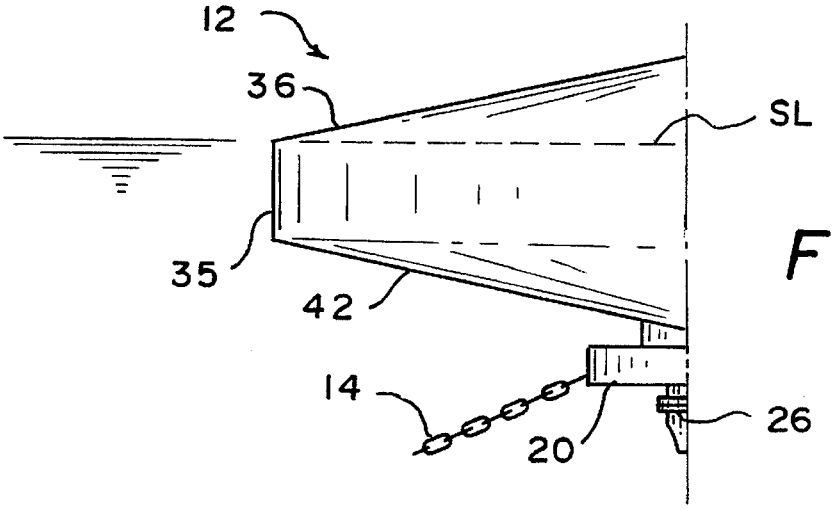
FIG. 3
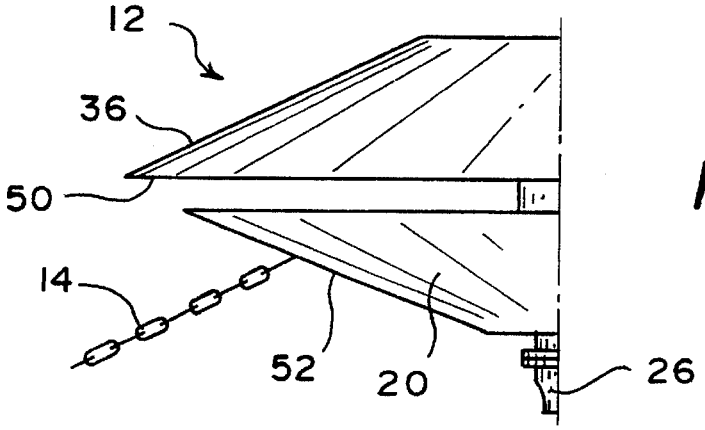
FIG. 4

CANTENARY ANCHOR LEG MOORING BUOY

BACKGROUND OF THE INVENTION

The present invention relates in general to a mooring buoy which is particularly designed to dive through large, steep swells or waves, including those which may break upon impact with the buoy.

Catenary Anchor Leg Mooring (CALM) buoys are often employed as offshore loading facilities for transferring oil from an onshore or offshore location to an oil tanker, or from an oil tanker to a reception facility. These types of buoys are so named because they employ a plurality of catenary anchor chains to hold the buoy generally in place. An advantage of these buoys is that they do not require construction of a costly jetty or dock for mooring the oil tankers. However, since offshore loading facilities are often located in unprotected waters, the buoys must be designed to accommodate and withstand great environmental forces produced by large swells or waves, high winds and/or strong currents. These environmental forces can become particularly fierce when the buoy is placed in a very shallow location because the waves tend to build up and become very steep before they break in the shallow water.

Typically, the previous CALM buoys have been made with a rectangular vertical cross-section which has a relatively high drag resistance. In addition, the buoys have been made so that they will attempt to climb over the waves as the waves pass by. As a result, very large forces are imposed both on the buoy and the anchor chains holding the buoy. In the past, this problem has been either avoided by moving the buoy further offshore in order to avoid the steep breaking waves, or accommodated by increasing the chain diameter in order to withstand the high forces. Most often, the final design and placement of the buoy represents a compromise between moving the buoy further offshore and increasing the diameter of the anchor chains. Unfortunately, both of these solutions increase the cost of the offshore loading facility considerably.

SUMMARY OF THE INVENTION

The present invention addresses the foregoing problem by providing a CALM buoy structure which is designed to reduce the environmental forces imposed by extreme waves so that the size of the buoy's anchor chains and the buoy structure itself can be minimized. This is accomplished through use of a design which allows the buoy to dive through large swells or waves without imparting undue stresses or drag to the buoy mooring components. More specifically, the buoy has a wedge shaped side cross-section which causes the buoy to dive through large waves or swells as it is struck by them. In addition, the wedge shape provides the buoy with a much lower drag coefficient than that of a conventional rectangular shaped buoy, and enables the buoy to dive through the large waves or swells without imparting undue stress to any of the buoy's mooring components.

The wedge shaped cross-section is achieved by providing the buoy with an inwardly angled sidewall section above the normal still water level. This provides the buoy with a reduced water plane area above the still water level, which reduces the uprighting force on the buoy, and causes it to dive downwardly at an angle when struck by a large wave. The buoy thus penetrates the wave at the lower part of the wavecrest where the wave particle velocities are generally much lower than at the top of the wavecrest, and this further reduces the stress imparted to the buoy and the catenary anchor chains.

Preferably, the buoy is also designed so that it has a hexagonal shape when viewed from the top. The hexagonal top cross-sectional shape is advantageous because it provides a less costly shape to fabricate than would a perfectly round buoy. The perfectly round buoy would require double curvature plates in order to embody the wedge shaped cross-section. These plates are much more time consuming to fabricate than the conventional flat plates employed in the hexagonal shaped buoy. Furthermore, the hexagonal shape is superior to a conventional square shape because it imparts lower drag forces on the water as it moves around the buoy.

BRIEF DESCRIPTION OF THE DRAWINGS

The foregoing and other advantages and features of the present invention will become apparent from the following detailed description of a preferred embodiment thereof, taken in conjunction with the accompanying drawings in which:

FIG. 2 is a top plan view of the buoy of FIG. 1;

FIG. 3 is a partial side view of an alternative buoy design which forms a second preferred embodiment of the present invention; and FIG. 4 is a partial side view of an alternative buoy design which forms a third preferred embodiment of the present invention.

DETAILED DESCRIPTION OF THE PREFERRED EMBODIMENT

Figure 1:
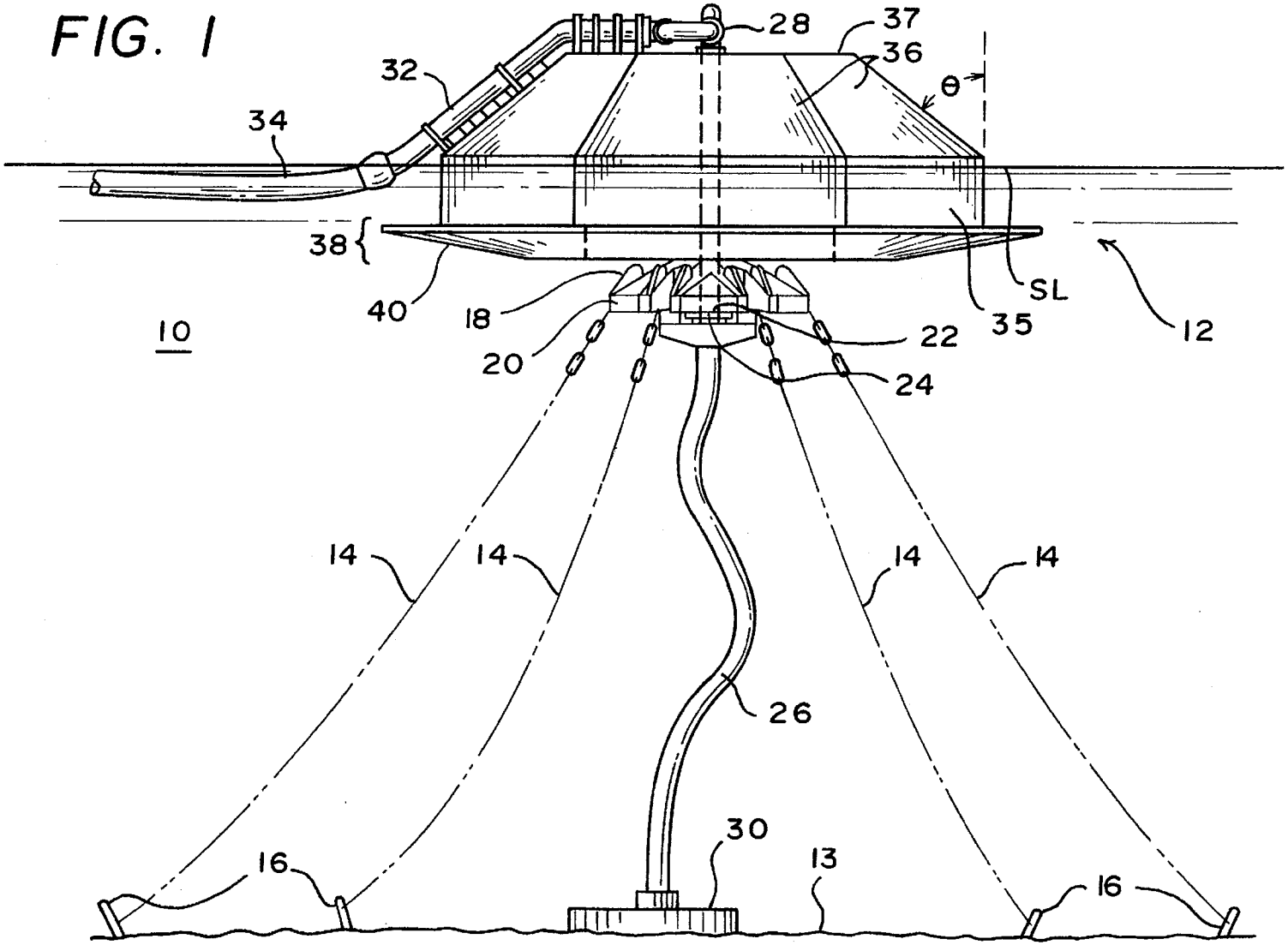
FIG. 1 is a side view of a buoy constructed in accordance with a first preferred embodiment of the invention.

Turning now to FIGS. 1 and 2, a first preferred embodiment of the present invention is illustrated comprising a cantenary anchor leg mooring (CALM) buoy 10. The CALM buoy 10 is so named because it includes a buoyant buoy 12 which is anchored to the seabed 13 by means of a plurality of mooring or anchor chains 14. During calm conditions, these chains each extend in the shape of a catenary wire from a corresponding seabed anchor or anchor pile 16 to a connection 18 on a mooring table 20.

The buoy 12 is rotatably attached to the mooring table 20 by means of a rotatable connection 22 which incorporates a bearing 24. If the CALM buoy 10 is employed in deep water, the mooring table 20 can incorporate a positive buoyancy means, such as, one or more air tanks or compartments (not shown), to reduce frictional forces on the bearing 24.

A flexible riser 26 passes through the center of the buoy 12, and is connected between a rotatable swivel joint 28 disposed on top of the buoy 12 and a pipeline end manifold (PLEM) 30 disposed on the seabed 13 for transferring oil or other fluids to or from an oil tanker. A section of pipe 32 is mounted on the buoy 12 which is connected at one end to the swivel joint 28 and can be connected at its other end to a floating hose 34 leading to an oil tanker (not shown).

A significant feature of the present invention is the wedge side cross-sectional shape of the buoy 12 as illustrated in FIG. 1. The buoy 12 includes a vertical lower sidewall 35, an inwardly angled upper sidewall 36 positioned above the normal still water level SL of the buoy 12, a top section 37 and a bottom section 38. The inwardly angled upper sidewall 36 is preferably positioned at an angle $\theta$ with respect to vertical of between 25° and 70°. If the angle $\theta$ is selected to be within this range of values, a large wave that approaches the buoy 12 will tend to wash over the angled upper sidewall 36. If the side of the buoy 12 which the wave first hits is designated as the forward section, the wave causes the stability of the buoy to shift aft as the wave runs up the angled upper sidewall 36, thereby reducing the water plane on the forward section, and causing the buoy 12 to dive downwards into the wave. The significance of the angled sidewall 36 is thus twofold. First, it provides the buoy 12 with a low drag coefficient so that it can dive through waves without placing excessive stress on the mooring or anchor chains 14. Second, its angle with respect to vertical is selected to cause the buoy 12 to dive downwardly through the waves to areas where the wave particle velocity is reduced, and this further reduces stress on the chains 14.

Preferably, the normally submerged bottom section 38 of the buoy 12 also has a wedge shaped cross-section to further reduce the drag coefficient of the buoy 12. In the embodiment illustrated in FIG. 1, the bottom section 38 of the buoy 12 includes an inwardly angled bottom sidewall 40 which is angled in the opposite direction from vertical than that of the top sidewall section 36, and at a somewhat greater angle. Alternatively, as illustrated in FIG. 3, the bottom section 38 can be a mirror image of the top sidewall 36, with an inwardly angled lower sidewall 42 also positioned between 25° to 70° from vertical. Yet another embodiment of the buoy 10 is illustrated in FIG. 4 in which the buoy 12 still includes the inwardly angled upper sidewall 36, but has a flat bottom surface 50. In this embodiment, the bottom wedge shape of the buoy 12 is achieved by making the mooring table 20 wider, and providing it with an inwardly and downwardly angled sidewall 52.

Another significant feature of the present invention is the hexagonal top cross-sectional shape of the buoy 12 as best illustrated in FIG. 2. To achieve the hexagonal shape, each of the sidewalls 35, 36 and 40 is formed from six individual flat plate sections. From an operational standpoint, the hexagonal shape of the buoy 12 is advantageous because it has a lower drag coefficient than does a conventional square buoy, and thus generates lower drag forces as the water moves around the buoy 12. Although a perfectly round buoy would provide even less drag, the hexagonal shape is preferable because it is less costly to fabricate than is a perfectly round buoy. In particular, the perfectly round buoy would require double curvature plates in order to embody the wedge shape side cross-section. These plates are much more time consuming to fabricate than conventional flat plates so that the hexagonal shaped buoy is much easier and inexpensive to fabricate.

In summary, all three embodiments of the present invention provide CALM buoy designs which are particularly suited for use in rough, unprotected waters, and provide a unique inexpensive solution to the problem of accommodating large, steep waves or swells and strong currents. The wedge shaped side design of the buoy causes it to dive downwardly into large waves where the particle velocities of the waves are less, thereby eliminating the need for larger chain diameter and excessive reinforcement of the buoy structure. The hexagonal top shape of the buoy provides a means of simplifying its fabrication by avoiding double curvature plates as would be required for a round buoy, yet it still provides the buoy with a lower drag coefficient than that of a square buoy since the water can move around a hexagonal shaped buoy easier.

Although the present invention has been described in terms of a number of preferred embodiments, it will be understood that numerous additional modifications and variations could be made thereto without departing from the scope of the invention as set forth in the following claims.

What is claimed is:

1. A cantenary anchor leg mooring buoy apparatus comprising:

a) a buoy;

b) a plurality of mooring chains;

c) means for securing said buoy to said plurality of mooring chains; and d) means for causing said buoy to dive at an angle downwardly through large waves, said means for causing said buoy to dive comprising an inwardly angled upper sidewall of said buoy formed of a plurality of flat sections.

2. The apparatus of claim 1, wherein said inwardly angled sidewall section is positioned at an angle of between approximately 25° and 70° from vertical.

3. The apparatus of claim 2, wherein said buoy further includes a bottom section with an inwardly angled lower sidewall.

4. The apparatus of claim 3, wherein said inwardly angled lower sidewall is positioned at an angle of between approximately 25° and 70° from vertical.

5. The apparatus of claim 1, wherein said buoy further includes a bottom section with an inwardly angled lower sidewall.

6. The apparatus of claim 5, wherein said inwardly angled lower sidewall is positioned at an angle of between approximately 25° and 70° from vertical.

7. The apparatus of claim 1, wherein said means for securing said buoy further comprises:

i) a mooring table;

ii) means for mounting said buoy on said mooring table; and iii) means for attaching said plurality of mooring chains to said mooring table.

8. The apparatus of claim 7, further comprising means for conveying fluid through a center of said buoy.

9. The apparatus of claim 7, wherein said means for causing said buoy to dive comprises an inwardly angled upper sidewall of said buoy which is normally above a still water line of said buoy.

10. The apparatus of claim 9, wherein said inwardly angled sidewall section is positioned at an angle of between approximately 25° and 70° from vertical.

11. The apparatus of claim 10, wherein said buoy further includes a bottom section with an inwardly angled lower sidewall.

12. The apparatus of claim 11, wherein said inwardly angled lower sidewall is positioned at an angle of between approximately 25° and 70° from vertical.

13. The apparatus of claim 9, wherein said buoy further includes a bottom section with an inwardly angled lower sidewall.

14. The apparatus of claim 13, wherein said inwardly angled lower sidewall is positioned at an angle of between approximately 25° and 70° from vertical.

15. The apparatus of claim 9, wherein said mooring table includes an inwardly and downwardly angled sidewall.

16. The apparatus of claim 1, wherein said buoy has a hexagonal shaped top cross-section.

17. The apparatus of claim 16, wherein said inwardly angled upper sidewall is further comprised of six flat plate sections.

* * * * *